US005403214A

United States Patent [19]

Tirrell

[11] Patent Number: 5,403,214

[45] Date of Patent: Apr. 4, 1995

[54] GROUNDING JACK

[75] Inventor: Paul T. Tirrell, Uxbridge, Mass.

[73] Assignee: EMC Corporation, Hopkinton, Mass.

[21] Appl. No.: 150,959

[22] Filed: Nov. 12, 1993

[51] Int. Cl.[6] ..... H01R 17/18; H05F 3/02

[52] U.S. Cl. ..... 439/825; 361/212; 439/37; 439/434

[58] Field of Search ..... 439/101, 107, 37, 96, 439/97, 433, 434, 550, 551, 560, 95, 825; 361/212, 220

[56] References Cited

U.S. PATENT DOCUMENTS

| | | | |
|---|---|---|---|
| 4,421,369 | 12/1983 | Myking | 439/551 X |
| 4,693,688 | 9/1987 | Lembruch et al. | 439/101 X |
| 4,722,025 | 1/1988 | Robinson | 361/212 OR |
| 4,802,056 | 1/1989 | Aronson | 361/212 |
| 4,945,447 | 7/1990 | Aronson | 361/212 |
| 5,051,732 | 9/1991 | Robitaille | 340/650 |

*Primary Examiner*—David L. Pirlot
*Assistant Examiner*—Daniel Wittels
*Attorney, Agent, or Firm*—Bourque, Daniel, Davis, Anthony, Bujold, Michael

[57] ABSTRACT

A grounding jack for mechanically and electrically securely coupling a device to be grounded to a ground conducting member includes a generally circular shaped grounding jack having a first end adapted to be inserted into a grounding jack receiver hole in the ground conducting member. The grounding jack receiver hole includes a first predetermined diameter. A second end of the ground conducting jack is adapted for receiving a ground coupling plug from a device to be grounded. A central bore region, into which the ground coupling plug is inserted, extends from the second end to proximate the first end, and is substantially surrounded by a grounding jack wall region. Also included is a ground conducting member engaging region which has a predetermined diameter larger than the predetermined diameter of the grounding jack receiver hole in the ground conducting member, and preferably includes a knurled outside surface, for mechanically and electrically securely engaging with a sidewall of the grounding jack receiver hole. The grounding jack further includes a cutout region forming a slot extending the length of the grounding jack, which allows the ground conducting member engaging region to be compressed in diameter and inserted into the smaller diameter grounding jack receiver hole in the ground conducting member, for providing constant tension for the ground conducting member engaging region against the sidewall portion of the grounding jack receiver hole.

8 Claims, 5 Drawing Sheets

GROUNDING JACK

FIELD OF THE INVENTION

This invention relates to anti-static grounding products and more particularly, to a grounding jack which may be inserted into a hole in a ground conducting material to serve as a grounding jack into which can be electrically connected an anti-static or other similar grounding type plug.

BACKGROUND OF THE INVENTION

It is well known and very well documented in the prior art that electronic components used in today's electronic products are extremely sensitive to damage caused by electrostatic discharge. Such damage occurs when the electronic component is in close proximity with a source of increased electrostatic energy, such as routinely builds up in the body and clothing of electronic assemblers, technicians and engineers.

Accordingly, the prior art solution to this problem is to provide an individual with a grounding strap which is typically attached to the individual's wrist, but also may be attached to the individual's leg, floor mat or work surface.

Typically, technicians, whether in-house or field service, and other individuals who frequent various locations of electronics products, such as engineers, carry an anti-static wrist strap which contacts their wrist, and attaches to an alligator type clip by means of a conductor such as a wire. Upon approaching a piece of electronic circuitry which is to be handled, the individual will fasten the clip to a conducting member, such as the electronics cabinet or work surface, and then subsequently feel confident that any electrostatic energy has been discharged through the cabinet, thus allowing them to safely handle the electronic components.

Unfortunately, in many instances, this system gives a false sense of security because in fact, electrostatic energy has not been discharged due to a number of factors. Firstly, many electronic component cabinets have been painted or anodized which does not provide good electrical contact between the alligator clip coupled to the wrist strap and the sheet metal which comprises the electronics cabinet. Even in those instances when the alligator clip does pierce the anodization or coating on the electronic cabinet, the plating or paint greatly reduces or minimizes the electrical coupling between the wrist strap and the grounded metal frame of the cabinet.

Additionally, as the technician or engineer is servicing the electronic devices in the cabinet, the alligator clip attached to the electrical wire coupled to the wrist strap will very frequently and easily disengage or become unclipped from the metal frame. At that point, the engineer or technician, often unknowingly, is no longer protected against the serious damage which can be imposed by electrostatic discharge.

Accordingly, what is needed is a means for securely and positively electrically engaging the currently available anti-static grounding straps with electronic cabinets or other ground conducting members to which the technician or engineer wishes to be grounded.

SUMMARY OF THE INVENTION

The present invention features a generally circular or barrel shaped grounding jack, for mechanically and electrically securely coupling a ground coupling plug from a device to be grounded, to a coupled grounding member.

The grounding jack includes a first end, adapted to be inserted into a grounding jack receiver hole provided in a ground conducting member. The grounding jack receiver hole has a first predetermined diameter somewhat larger than the diameter of the first end of the grounding jack. The grounding jack further includes a second end, adapted for receiving the ground coupling plug from the device to be grounded. A central bore region, having an inside diameter corresponding approximately to the diameter of the ground coupling plug from the device to be grounded extends from the second end of the grounding jack to the first end. The central bore region has a second predetermined diameter which is less than that of the first predetermined diameter of the first end, thus providing a grounding jack wall region substantially surrounding the central bore region.

Also provided is a ground conducting member engaging region having a third predetermined diameter larger than the first predetermined diameter of the grounding jack receiver hole in the grounding jack conducting member. The ground conducting member engaging region is located proximate the second end of the grounding jack, and mechanically and electrically securely engages with a sidewall region of the grounding jack receiver hole.

The grounding jack of the present invention also features a cutout region in the grounding jack wall region which forms a cutout slot in the wall region extending parallel to a longitudinal axis that runs through the central bore region from the second end to the first end, for allowing the third predetermined diameter of the ground conducting engaging region to be reduced to generally correspond to the first predetermined diameter of the grounding jack receiver hole, for tensioning the ground conducting member engaging region against the sidewall region of the grounding jack receiver hole, for mechanically and electrically securely engaging the grounding jack with the ground conducting member.

In the preferred embodiment, the ground conducting member engaging region includes a knurled outside surface for both mechanically and electrically securely engaging with the sidewall portion of the grounding jack receiver hole. Additionally, the second end of the grounding jack includes a flanged region having a diameter greater than the diameter of the grounding jack receiver hole, for ensuring that the grounding jack does not fall or pass through the grounding jack receiver hole and the ground conducting member.

In one embodiment, the flanged region extends above the outside surface of the ground conducting member whereas in the second embodiment, the grounding jack receiver hole includes a tapered region which corresponds to a tapered region and the flange portion of the second end, to allow the grounding jack of this embodiment to be flush-mounted with the outside surface of the ground conducting member.

The ground conducting member may be fabricated from one of several different materials, based upon the type of material from which the ground conducting member is fabricated. For example, for a sheet metal ground conducting member or frame, 303 or 305 stainless steel is generally the preferred material, where as for an aluminum chassis, the grounding jack may be constructed from brass or aluminum.

The present invention also includes a method of utilizing such a ground conducting jack including the steps of providing a hole in a ground conducting member, and inserting into the hole a grounding jack, such that a ground conducting member engaging region of the grounding jack mechanically and electrically engages with sidewall regions of the grounding jack receiver hole. Subsequently, a ground coupling plug from a device to be grounded is inserted into the central bore region of the ground conducting jack.

DESCRIPTION OF THE DRAWINGS

These, and other features and advantages of the present invention will be better understood by reading the following detailed description, taken together with the drawings wherein.

DETAILED DESCRIPTION OF THE INVENTION

Figure 1:
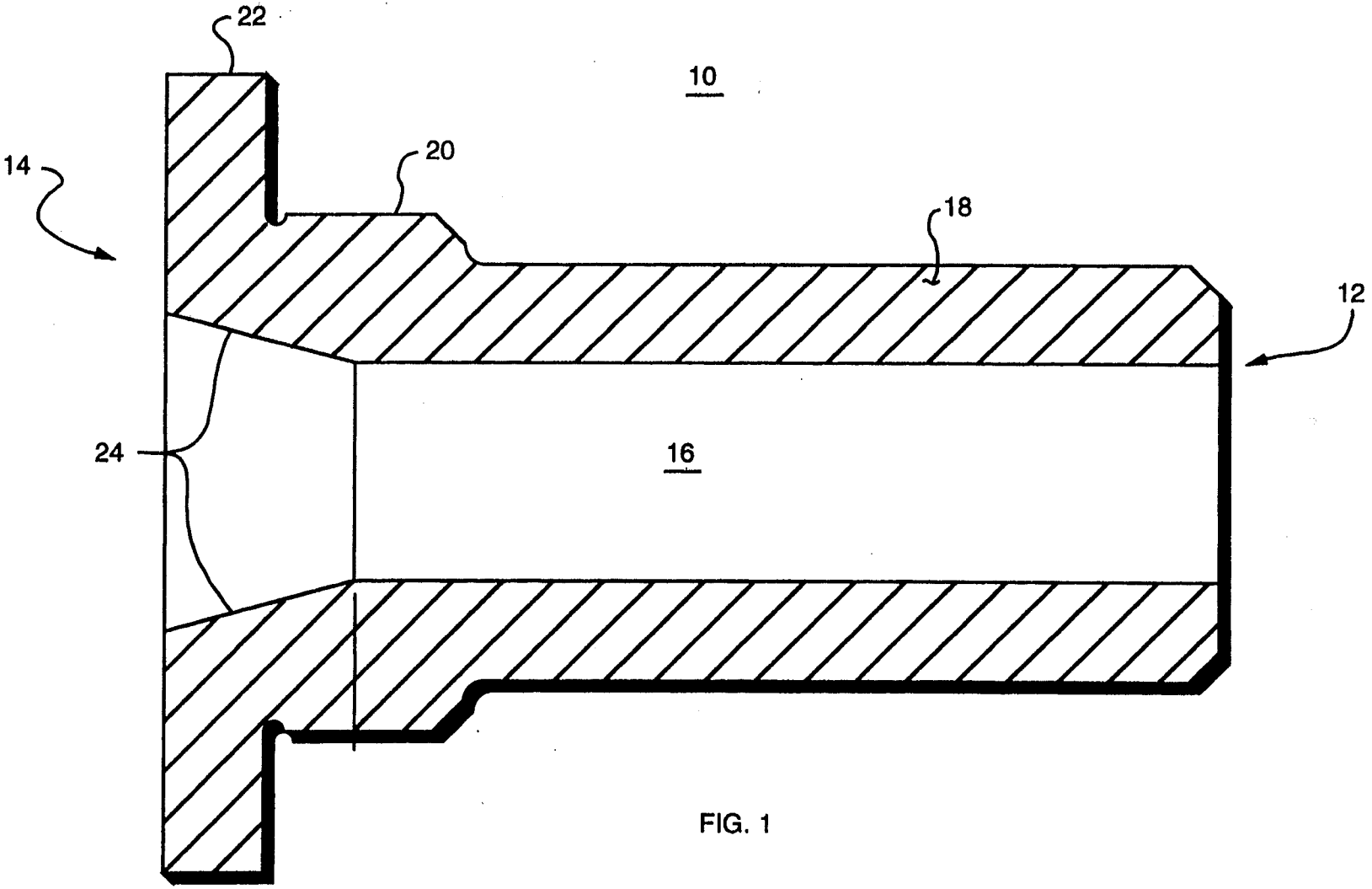
FIG. 1 is a cross-sectional view of the grounding jack according to the present invention.

The present invention features a grounding jack 10, FIG. 1, including a first end 12 which is adapted to be inserted into a hole in a ground conducting member, and a second end 14 into which is inserted a ground coupling plug from a device to be grounded. A central bore region 16 extends between the first and second ends 12, 14, and provides a region into which is inserted the ground coupling plug from the device to be grounded. Substantially surrounding the central bore region 16 is a grounding jack wall region 18.

The grounding jack of the present invention also includes a ground conducting member engaging region 20 which has a predetermined diameter larger than the diameter of a grounding jack receiver hold in a ground conducting member, to allow the ground conducting member engaging region to securely both mechanically and electrically couple to the ground conducting member. In this embodiment, the second end of 14 of the grounding jack 10 includes a flanged end region 22 having a diameter which is larger than the diameter of the grounding jack receiver hole provided in the ground conducting member, for assuring that the grounding jack 10 of the present invention does not pass through or otherwise disengage with the grounding jack receiver hole. The preferred embodiment of the present invention also includes a tapered region 24 in the central bore region 16 proximate the second end 14, to allow easy insertion of a ground coupling plug attached to the device to be grounded.

The beveled region 24 includes a diameter of approximately 0.2 inches at the widest point, and tapers to the inside diameter of the barrel, approximately 0.125 inches, after approximately 0.121 inches from the end portion of the tapered region.

In the preferred embodiment, the overall length of the grounding jack 10 is approximately 0.50 inches from end to end. The flange or shoulder region 22 is approximately 0.03 to 0.05 inches in thickness while the ground conducting member engaging region 20 is approximately 0.250 inches. The remainder of the barrel of the grounding jack measures approximately 0.5 inches. In the preferred embodiment, the grounding jack receiver hole (not shown) has a diameter of approximately 0.290 inches (L drill size) to 0.295 inches (M drill size) whereas the first end 12 of the grounding jack has a predetermined diameter of approximately 0.275 inches. The ground conducting mender engaging region 20 includes a diameter of approximately 0.310 inches whereas the diameter of the flanged end region 22 of second end 14 is approximately 0.75 inches.

In order to prevent corrosion or oxidation of the grounding jack 10 of the present invention, the preferred embodiment contemplates that the grounding jack be fabricated from stainless steel, for coupling with a sheet metal panel or frame serving as the ground conducting member. For an aluminum ground conducting member, the grounding jack may be fabricated from brass or aluminum. It is understood that dimensions as well as fabrication material may be selected to suit the particular needs or application desired, and is considered to be clearly within the scope of the present invention.

Figure 2:
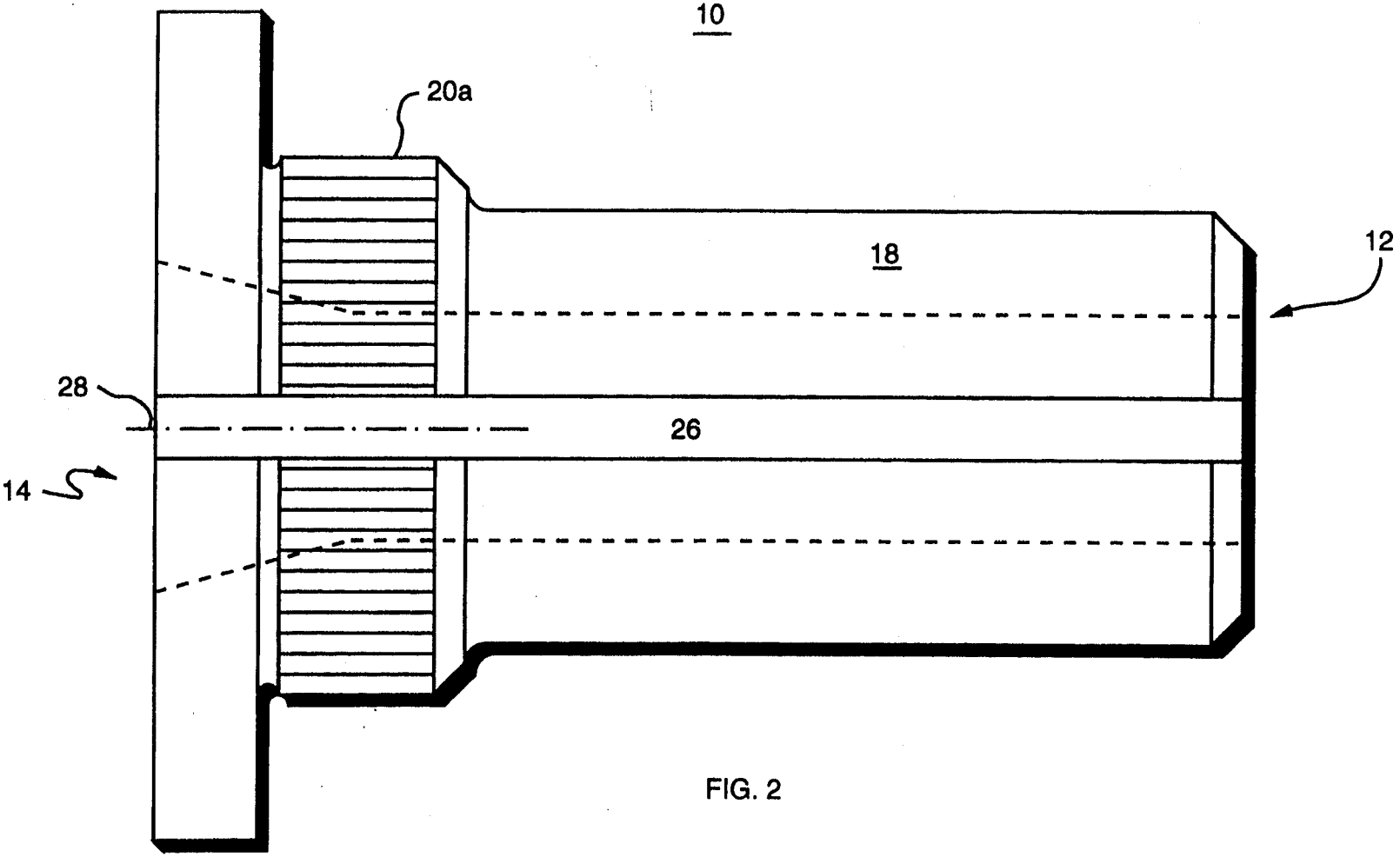
FIG. 2 is a prospective view of one embodiment of the grounding jack according to the present invention.

As shown in a prospective view in FIG. 2, the grounding jack 10 of the present invention preferably includes a ground conducting member engaging region **20*a* having a knurled outside portion for securely engaging with a sidewall region of the grounding jack receiver hole provided in a ground conducting member. In this embodiment, the outside portion of the ground conducting member engaging region 20*a*** includes a straight knurl of approximately 64 DP. (Diametrial Pitch indicating the number of teeth per inch).

An important feature of the present invention is the ability to very securely mechanically and electrically engage the conducting member engaging region **20*a* with a sidewall region of a grounding jack receiver hole. Since the diameter of the ground conducting member engaging region 20*a* is slightly larger than the diameter of the grounding jack receiver hole, the present invention includes a cutout region 26 in the ground jack wall portion 18. The cutout region 26 forms a longitudinal slot which is parallel to a longitudinal axis 28 which extends through the central bore region 16 of the grounding jack. The cutout slot 26 extends from the second end 14 of the grounding jack to the first end 12. The slot or cutout which is approximately 0.040 inches in thickness allows the ground conducting member engaging region 20, 20*a* to be reduced in diameter when inserted into the grounding jack receiver hole in the ground conducting member. The cutout slot also provides a constant means of tension on the ground conducting member engaging region 20*a*** against the sidewall region of the grounding jack receiver hole, for mechanically and electrically securely engaging the grounding jack with the ground conducting member.

Figure 3:
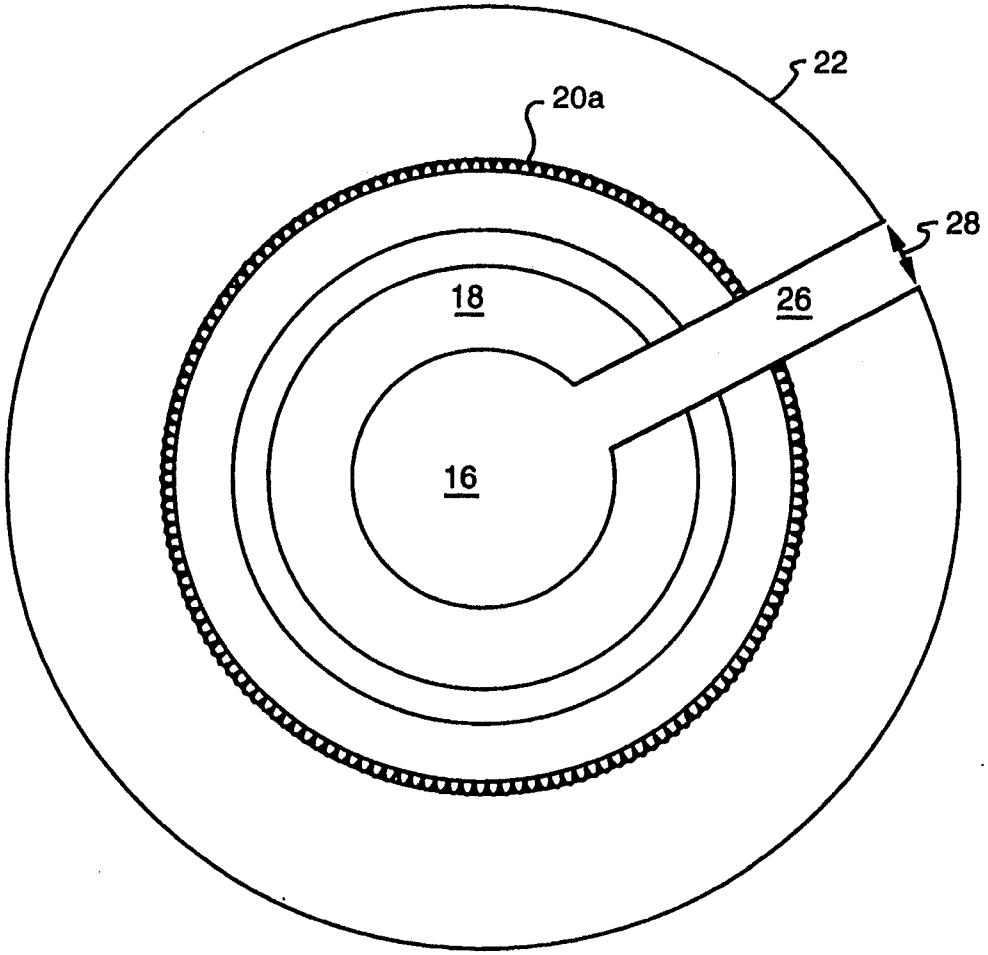
FIG. 3 is an end view of the grounding jack according to the present invention.

As shown more clearly in FIG. 3, the cutout region or slot 26 extends from the outside of the flanged portion 22 of the first end 14 all the way through the central bore region 16, thus allowing the flanged portion 22, knurled ground conducting member engaging region **20*a* and grounding jack sidewall portion 18 to move in the direction indicated generally by arrow 28**.

Figure 4:
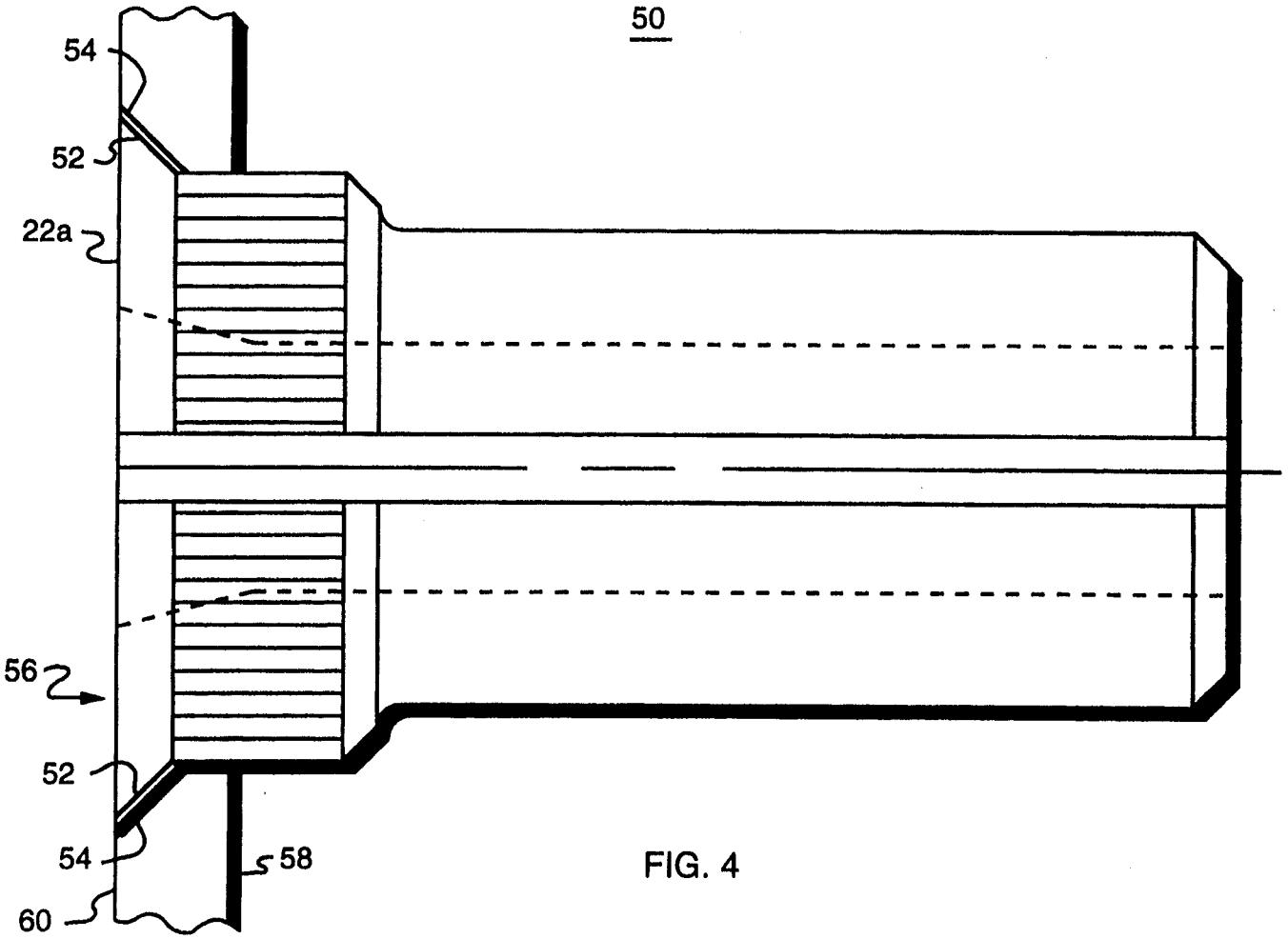
FIG. 4 is a prospective view of an alternative embodiment of a grounding jack according to the present invention.

A second embodiment 50, FIG. 4, of the grounding jack of the present invention contemplates providing a flanged portion **22*a* with inwardly tapered portion 52, which corresponds to an inwardly tapering portion 54 formed adjacent the hole 56 in the ground conducting member 58. Such a taper in both the hole 56 and flange 22a allows the grounding jack 50 of the second embodiment of the present invention to be flush-mounted with the outer surface 60 of ground conducting member 58**.

Figure 5A:
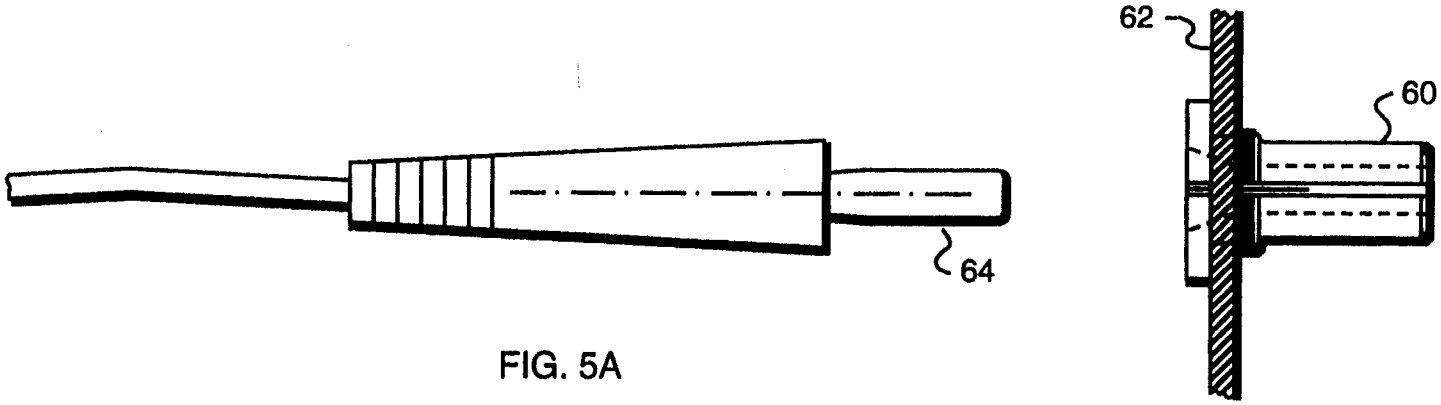
FIGS. 5A and 5B illustrate the connection of the grounding jack of the present invention with a plug electrically coupled to a device to be grounded.
Figure 5B:
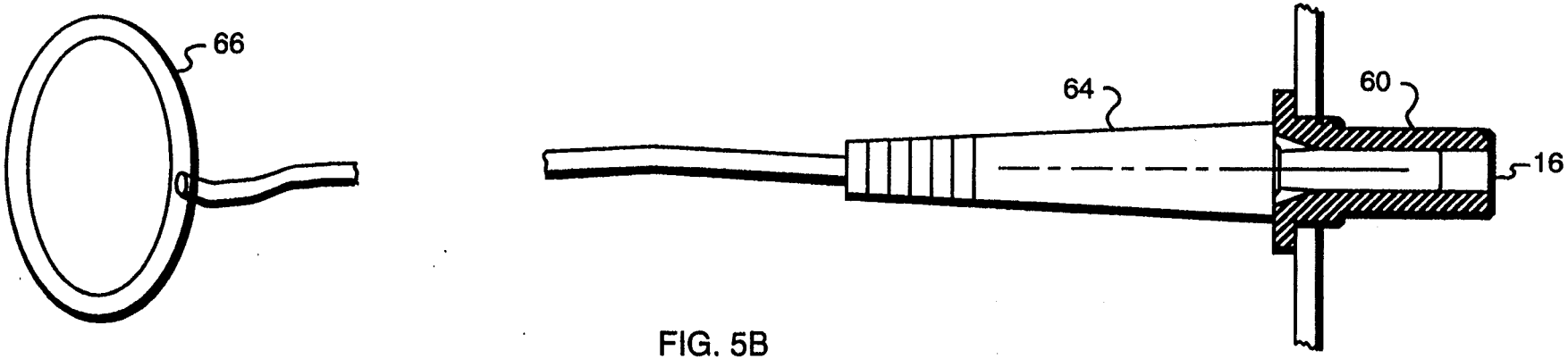

As shown in greater detail of FIGS. 5A and 5B, the grounding jack of the present invention is adapted to be inserted into any one of a number of properly sized holes drilled into a ground conducting member such as an electronic cabinet. In this manner, a in-house or field service technician or engineer can easily install the low cost grounding jack of the present invention in one or more of the provided grounding jack receiver holes, to facilitate the insertion of a grounding plug connected to a grounding device such as a wrist strap.

As shown in FIG. 5A, the grounding jack 60 is inserted into a hole in the ground conducting member 62 by means of moderate force applied by a device such as a hammer or screwdriver handle. Subsequently, a grounding plug 64 coupled to a device to be grounded such as wrist strap 66, is inserted into the central bore region 16 of the grounding jack 60. Grounding plug 64 is a standard "banana jack" type plug which is nearly universally provided in the electronics industry to couple an ESD (Electrostatic Discharge) grounding device such as a wrist strap to a grounded location.

Although the present invention has been described in conjunction with the first and second presented specific embodiments, modifications and substitutions by one of ordinary skill in the art are considered to be clearly within the scope of the present invention which is not to be limited except by the claims which follow.

I claim:

1. A generally circular shaped grounding jack, for mechanically and electrically securely coupling a ground plug connected to a device to be grounded, said grounding jack comprising:

a first end, for insertion into a grounding jack receiver hole provided in a ground conducting member, said grounding jack receiver hole having a first predetermined diameter;

a second end, adapted for receiving said grounding plug from said device to be grounded;

a central bore region, extending from said second end to proximate said first end, said central bore region having a second predetermined diameter less than said first predetermined diameter of said first end, and substantially surrounded by a grounding jack wall region;

a ground conducting member engaging region located proximate said second end, said ground conducting member engaging region having a third predetermined diameter larger than said first predetermined diameter of said grounding jack receiver hole in said ground conducting member, said ground conducting member engaging region adapted for mechanically and electrically securely engaging with a side wall region of said grounding jack receiver hole; and a cutout region in said grounding jack wall region, said cutout region extending parallel to a longitudinal axis that passes through said central bore region, for forming a cutout slot in said grounding jack wall region extending from said second end to proximate said first end, for allowing said third predetermined diameter of said ground conducting member engaging region to be reduced to generally correspond to the first predetermined diameter of said grounding jack receiver hole, and for tensioning said ground conducting member engaging region against said sidewall region of said grounding jack receiver hole, for mechanically and electrically securely engaging said grounding jack with said ground conducting member.

2. The system of claim 1 wherein said second end includes a flanged region having a diameter substantially larger than the first predetermined diameter of said grounding jack receiver hole, said flanged end region abutting an area adjacent said grounding jack receiver hole in said ground conducting member, for preventing said grounding jack from passing through said grounding jack receiver hole in said ground conducting member.

3. The grounding jack of claim 1 wherein said sidewall region of said grounding jack receiver hole includes a tapered region, a first portion of said tapered region having a diameter larger than a second portion of said tapered region; and said second end of said grounding jack including a tapered flanged end region, said tapered flanged end region having a tapered surface which corresponds to the tapered sidewall region of said grounding jack counter sunk receiver hole, for allowing said grounding jack to mount flush with a first surface of said ground conducting member.

4. The system of claim 1 wherein said ground conducting member engaging region includes a knurled outside portion, said knurled outside portion for engaging with said sidewall region of said grounding jack receiver hole.

5. The grounding jack of claim 1 wherein said grounding jack is constructed from a material selected from the group consisting of stainless steel brass and aluminum.

6. The grounding jack of claim 1 wherein said grounding device includes a wrist strap.

7. The grounding jack of claim 1 wherein said central bore region includes a beveled region proximate said second end, for facilitating insertion of said ground coupling plug in said grounding jack.

8. A method for mechanically and electrically securely coupling a device to be grounded to a ground conducting member, comprising the steps of:

drilling a generally circular grounding jack receiver hole in a ground conducting member, said grounding jack receiver hole having a first predetermined diameter;

inserting a grounding jack in said grounding jack receiver hole of said ground conducting member, said grounding jack including a ground conducting member engaging region having a second predetermined diameter larger than said first predetermined diameter of said grounding jack receiver hole, at least said ground conducting member engaging region including a cutout slot, for allowing at least said second predetermined diameter of said ground conducting member engaging region to be reduced to generally correspond to the first predetermined diameter of said ground conducting jack receiver hole, for tensioning said ground conducting member engaging region against a sidewall region of said grounding jack receiver hole in said ground conducting member, for mechanically and electrically securely engaging said grounding jack with said ground conducting member; and inserting a grounding plug, into a central bore region of said grounding jack, said grounding plug electrically coupled to a device to be grounded, for electrically coupling said device to be grounded to said ground conducting member.

* * * * *